US006459060B1

(12) United States Patent
Bartok

(10) Patent No.: US 6,459,060 B1
(45) Date of Patent: Oct. 1, 2002

(54) GULL WING ROCKER SWITCH

(75) Inventor: Stephen Bartok, Rancho Palos, CA (US)

(73) Assignee: Judco Manufacturing, Incorporated, Harbor City, CA (US)

( * ) Notice: Subject to any disclaimer, the term of this patent is extended or adjusted under 35 U.S.C. 154(b) by 179 days.

(21) Appl. No.: 09/624,152

(22) Filed: Jul. 24, 2000

(51) Int. Cl.[7] ..... H01H 1/22; H01H 5/08; H01H 21/00

(52) U.S. Cl. ..... 200/553; 200/244; 200/339; 200/437

(58) Field of Search ..... 200/6 B–6 C, 200/275, 402–412, 339, 237–245, 271–274, 553–563

(56) References Cited

U.S. PATENT DOCUMENTS

| | | | | |
|---|---|---|---|---|
| 2,478,564 A | | 8/1949 | Bordelon | 200/106 |
| 3,329,784 A | | 7/1967 | Rogero | 200/67 |
| 3,454,733 A | * | 7/1969 | Sanford et al. | 200/437 |
| 4,203,017 A | | 5/1980 | Lee | 200/339 |
| 4,335,287 A | | 6/1982 | Aschenbach et al. | 200/302 |
| 4,524,253 A | | 6/1985 | Sorenson | 200/68.2 |
| 4,978,823 A | | 12/1990 | Sato et al. | 200/437 |
| 5,158,172 A | | 10/1992 | Roeser et al. | 200/553 |
| 5,293,507 A | | 3/1994 | Hayakawa | 200/244 |

* cited by examiner

*Primary Examiner*—J. R. Scott
(74) *Attorney, Agent, or Firm*—Kenneth W. Float

(57) ABSTRACT

An electric rocker switch is disclosed having a gull wing shaped rocking contact. The rocking contact pivots on a center terminal between a pair of upright blades. A centering protrusion disposed on a lower surface of the rocking contact rests between the uprights blades of the center terminal when the rocking contact is in a center position, thus preventing lateral movement of the rocking contact beyond the limits of the upright blades. First and second rocker contacts are located on opposite sides of the rocking contact. The first and second rocker contacts face toward first and second fixed contacts, respectively. Thus, the first rocker contact touches the first fixed contact when the rocking contact rocks to one side and the second rocker contact touches the second fixed contact when the rocking contact rocks to the other side. Positioning surfaces and top inside edges of the upright blades serve as pivots for the rocking contact as it rocks from side to side.

22 Claims, 4 Drawing Sheets

GULL WING ROCKER SWITCH

FIELD OF THE INVENTION

The present invention relates generally to electric rocker switches, and more particularly, to switches including a gull wing shaped rocking contact having upper actuating surfaces and lower centering and pivoting surfaces.

BACKGROUND

Rocker actuated electrical switches are well known in the art and numerous designs thereof may be found in commerce. For example, as shown in FIG. 1, a switch 10 is disclosed in U.S. Pat. No. 4,203,017. The switch 10 comprises a rocking actuator 12 pivotally mounted on a pivot 14. A spring follower guide 18 is molded integrally with the rocking actuator 12 and extends downwardly therefrom. The spring follower 20 is reciprocally mounted in a cylindrical bore 22 in the spring follower guide 18, and a compression spring 24 is compressed between the top 26 of the bore and the bottom 28 of a counterbore 30 in the spring follower 20.

The compression spring 24 biases the spring follower 20 downwardly, in a direction to eject it from the spring follower bore 22 were it not restrained from such ejection. The spring follower 20 has a blunt point end portion 50 that presses against a rounded V-shaped portion 52 of a rocking contact 54. The V-shaped portion 52 is formed by a curved central part of a rocking contact 54 lying between and joining two upstanding, diverging portions 56, 58 of the rocking contact 54. Beyond the diverging portions, the rocking contact 54 bends downward, then outward at its respective ends to form contacts 74, 76. The contacts 74, 76 match respectively with side terminals 70, 72. The contacts 74, 76 and side terminals 70, 72 collectively form circuit making and breaking surfaces.

A known problem with such rocker switches 10 is the tendency of the rocking contact 54 to lose its centered rest position with respect to its supporting elements. There is a tendency for the rocking contact 54 to slide laterally or rotate angularly with respect to its support as it tilts from side to side. This adversely affects the ability of the contacts 74, 76 to make a clean break with the side terminals 70, 72. This sliding action can ultimately lead to switch failure by allowing the V-shaped portion 52 to come to rest away from its centered position, preventing one of the contacts 74, 76 from adequately breaking contact with its respective side terminal 70, 72.

To prevent this off-center sliding of the rocking contact 54, prior art devices have used various supporting and pivoting elements. As shown in FIG. 2, the rocking contact 54 has an integral rectangular conductive bearing plate 80 that rests in rectangular notches 82, 84 in the top edges of a pair of spaced apart parallel side walls 86, 88 of a center terminal 78. Ideally, the placement of the rectangular plate 80 in the notches 82, 84 limits the lateral movement of the rocking contact 54. However, lateral movement is only limited if the plate fits precisely within the notches 82, 84. This prerequisite requires a high degree of manufacturing accuracy. Accordingly, the tolerance for manufacturing flaws is low. If there are imperfections, as is common in the course of manufacturing, the rocking contact will still be able to shift laterally.

Additionally, the use of the rectangular plate 80 does not restrain the axis of angular rotation of the rocking contact 54 during switch operation. Although the plate 80 prevents lateral movement, the rocking contact 54 can still rotate and translate such that its axis of angular orientation is off-center.

Depending on the severity of this movement, the problem can cause the switch 10 to fail by biasing the switch 10 in the direction of one of the two contacts 74, 76. This affects the ability of the rocking contact 54 to make a clean break with the side terminal 72, 74 toward which it is biased. This may also affect the ability of the other contact to reach the side terminal 72, 74 on the opposite side. Accordingly, it is desirable to minimize both the lateral movement of the rocking contact 54 and movement of the axis of angular rotation and during the operation of the rocker switch 10.

Another disadvantage of known rocker switches is that, generally, the rotation angle of the rocking actuator 12 is in the range of 15 to 30 degrees. In modern applications, it is often ergonomically desirable to limit the angle of actuator rotation to under 10 degrees, and preferably, as low as 7 degrees. The problem with limiting the rotation angle of the rocking actuator 12 is that the motion of the spring follower 18 is likewise limited. If the spring follower 18 does not move sufficiently up the diverging portions 56, 58 of the rocking contact 54, it will not be able to exert enough force to cause one of the contacts 74, 76 to reach its respective side terminal 70, 72. Accordingly, it is desirable to limit the angle of the rocking actuator rotation while ensuring that sufficient force will be applied by the follower to enable the contact elements to make contact with the side terminals 70, 72.

There is, therefore, a need for a rocker switch in which the rocking contact and its supporting elements insure a reliable return of the contact to a centered rest position and which may be operated with a relatively low rotation angle of the rocking actuator. Therefore, it is an objective of the present invention to provide for a rocker switch that improves upon conventional designs.

SUMMARY OF THE INVENTION

To accomplish the above and other objectives, the present invention provides for an improved electric rocker switch. In a presently preferred embodiment, the present invention provides for an electric rocker switch having a gull wing shaped rocking contact. The rocking contact pivots on a pair of upright blades of a center terminal. At least one centering protrusion disposed on a portion of a lower surface of the rocking contact rests between the upright blades when the rocking contact is in a centered position, which prevents lateral movement of the rocking contact beyond limits of the upright blades. First and second rocker contacts are located on opposite sides of the rocking contact. The first and second rocker contacts face first and second fixed contacts, respectively, such that the first rocker contact touches the first fixed contact when the rocking contact rocks to one side, and the second rocker contact touches the second fixed contact when the rocking contact rocks to the other side. Positioning surfaces are disposed on the lower surface of the rocking contact adjacent to the centering protrusion. The positioning surfaces and top inside edges of the upright blades serve as pivots for the rocking contact as it tilts from side to side.

Other features and advantages of the present invention will become readily apparent to those skilled in this art from the following detailed description, wherein this and other presently preferred embodiments of the invention are shown and described by way of illustration of the best mode completed of carrying out the invention. As will be realized, the invention is capable of other and different embodiments, and its several details are capable of modifications in various obvious respects, all without departing from the invention. Accordingly the drawings and description are to be regarded as illustrative in nature and not as restrictive.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Referring to the FIGS. 3–8, the present invention provides an electric rocker switch 100 in which a gull wing shaped rocking contact 138 is utilized. The rocking contact 138 has separately formed upper and lower surfaces, each providing a different function in the operation of the switch 100. A portion of the upper surface cooperates with a follower 134, allowing for the change of the state of the switch 100 in response to an actuating force provided by an operator. The lower surface includes separate portions that provide centering and pivoting functions, respectively, allowing the rocking contact 138 to reliably return to a centered position.

Figure 1:
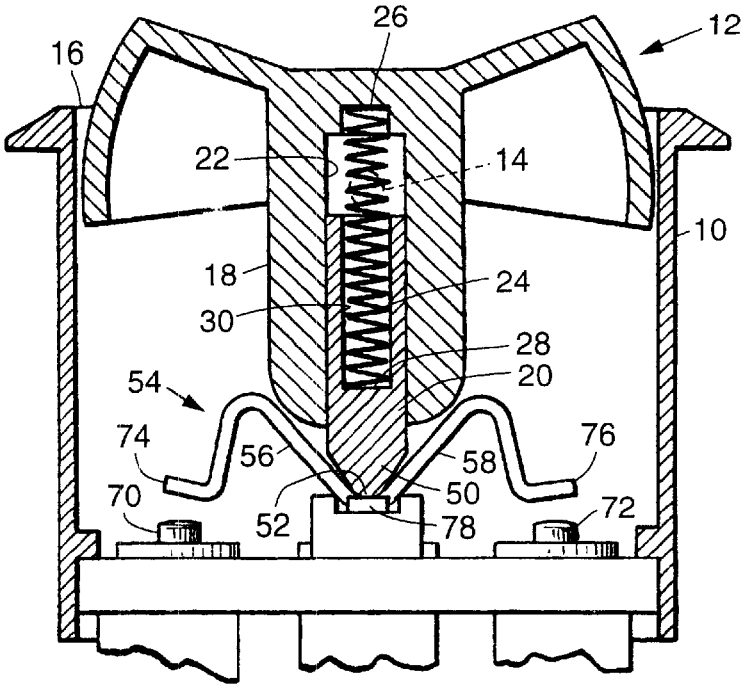
Fig. 1 (PRIOR ART)
FIG. 1 is a vertical cross-section of a conventional rocker switch.
Figure 2:
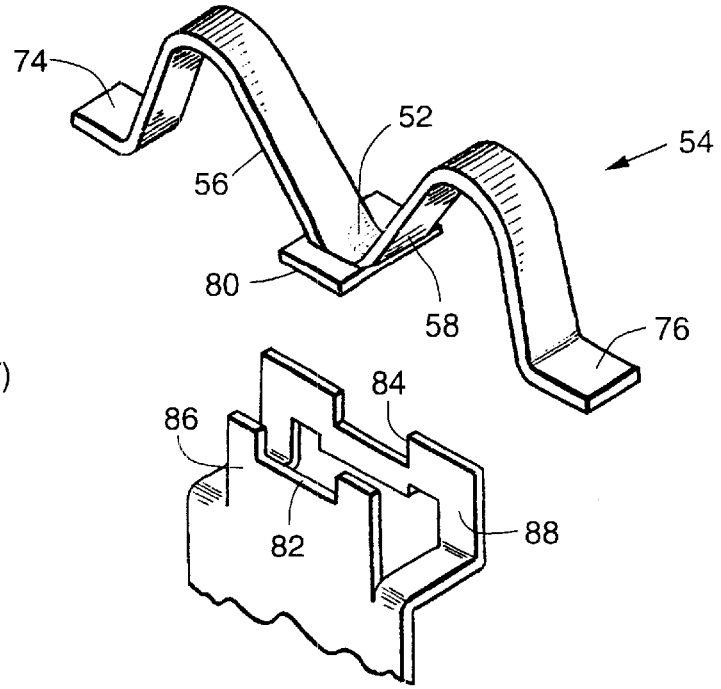
Fig. 2 (PRIOR ART)
FIG. 2 is an exploded isometric view of the switch elements of the switch shown in FIG. 1.
Figure 3:
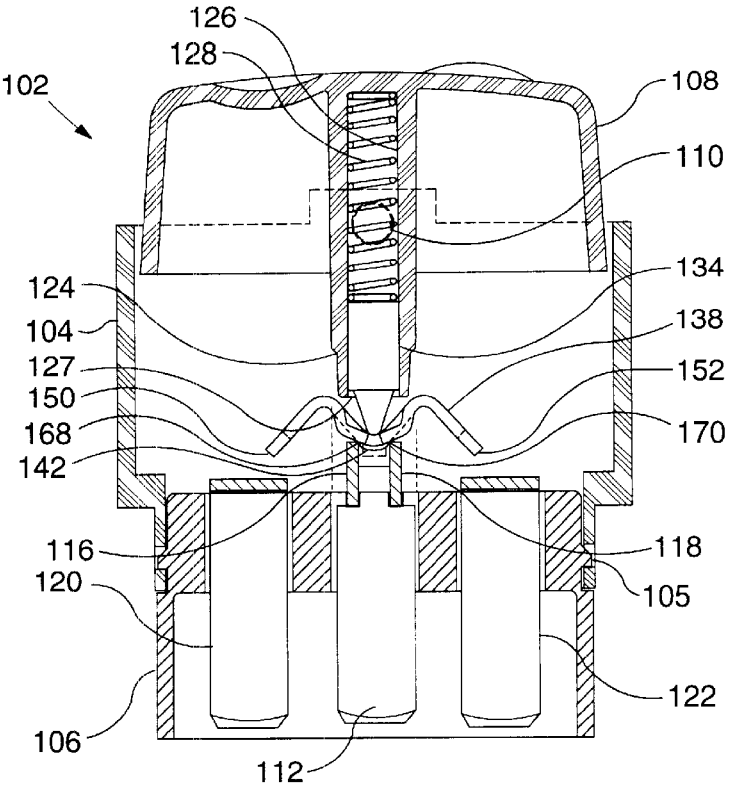
FIG. 3 is a vertical cross-section, showing the operating mechanism of a preferred embodiment of a gull wing rocker switch in accordance with the principles of the present invention in a centered off position.

A presently preferred embodiment of the invention is shown in FIG. 3, in a centered, off position. The switch 100 comprises a housing 102 having an upper portion 104 and a lower portion 106. The upper and lower portions 104, 106 are preferably formed with snaps 105 to allow their assembly by means of an interference fit. A generally rectangular shaped rocking actuator 108, having two pivoting protrusions, is pivotably attached an upper portion of the housing 102 by means of two apertures 110 in the housing.

A center terminal 112 is pressed through the lower portion 106. The center terminal 112 includes two spaced apart upright blades 116, 118 that are substantially parallel to each other. Side terminals 120, 122 are additionally pressed through the lower portion 106 on either side of the center terminal 112. The use of two side terminals 120, 122 in the presently preferred embodiment allows the switch 100 to operate as a double throw switch. however, one side terminal 120, 122 only may be employed if single throw switch operation is desired.

The rocking actuator 108 has a downwardly extending spring housing 124. The spring housing 124 includes an approximately cylindrical shaped inner surface 126 having an open end 127. The inner surface 126 slidably accommodates a compression spring 128 and a follower 134. The compression spring 128 urges the follower 134 out of the housing 124 against a gull wing shaped rocking contact 138.

Figure 4:
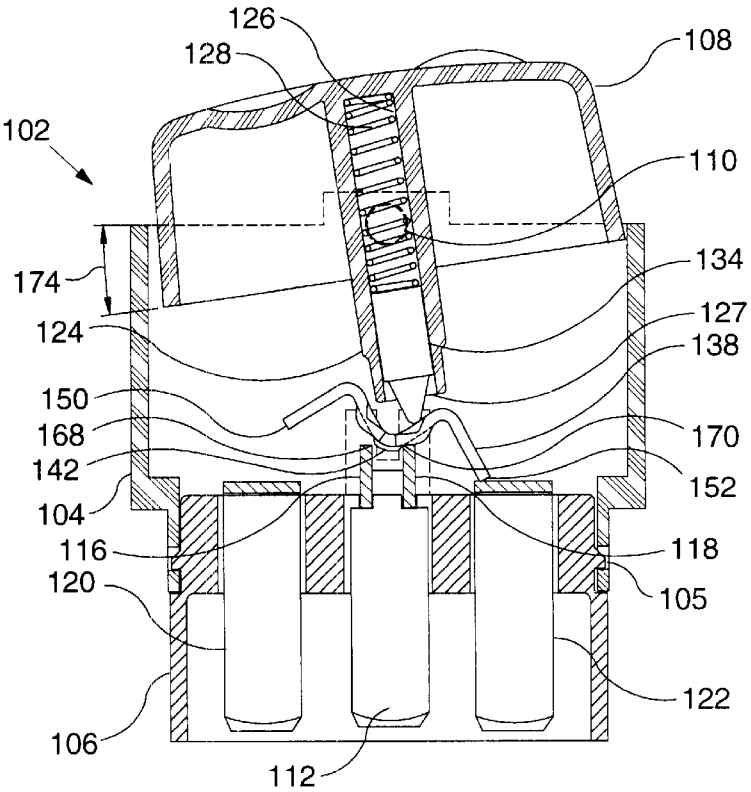
FIG. 4 is a vertical cross-section, showing the operating mechanism of a preferred embodiment of the gull wing rocker switch of the present invention in one of the on positions.
Figure 5:
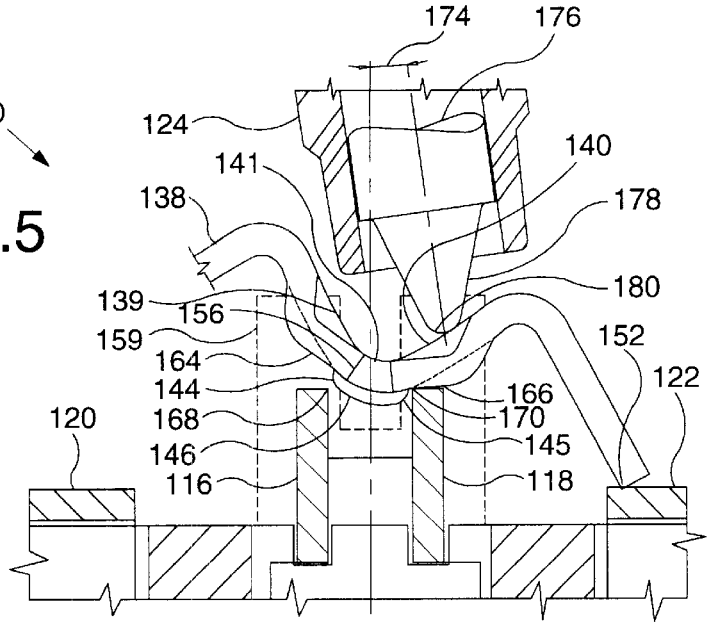
FIG. 5 is a side view of contact and actuating elements shown in FIG. 3.
Figure 6:
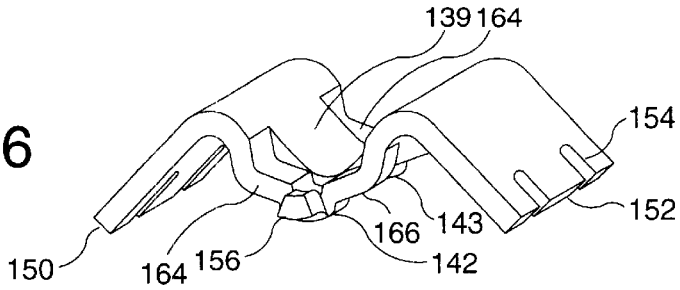
FIG. 6 is an isometric view of the contact element shown in FIG. 3.
Figure 7:
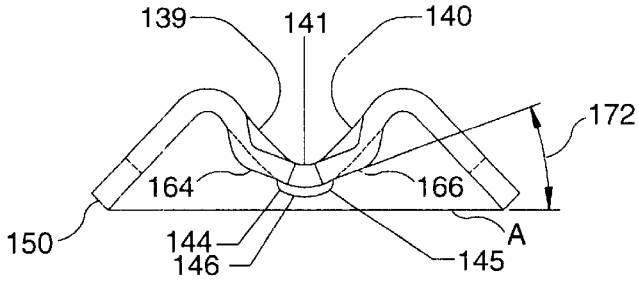
FIG. 7 is a side view of the contact element shown in FIG. 3.

Referring additionally to FIGS. 6 and 7, the rocking contact 138 includes first and second camming surfaces 139, 140 joined by a connecting camming surface 141. The camming surfaces 139, 140, 141 are located in the upper surface of the central portion of the rocking contact 138. With the switch 100 in a centered, off position, if one side of the rocking actuator 108 is pressed, the follower 134 moves from the connecting camming surface 141 to one of the first or second camming surfaces 139, 140, causing the rocking contact 138 to move from its centered, off, position to a side, on, position as shown in FIGS. 4 and 5.

The housing 102, rocking actuator 108 and the follower 134 are preferably constructed from a nonconducting rigid material, such as plastic. The rocking contact 138 and side terminals 120, 122 are constructed from an electrically conductive material that is sufficiently rigid to maintain its structure. It is best to utilize a material that minimizes formation of an oxide layer during switch operation. The rocking contact 138, center terminal 112 and side terminals 120, 122 are preferably manufactured from copper or a copper alloy such as bronze or brass. These elements are preferably formed from sheet stock employing a stamping process.

Figure 8:
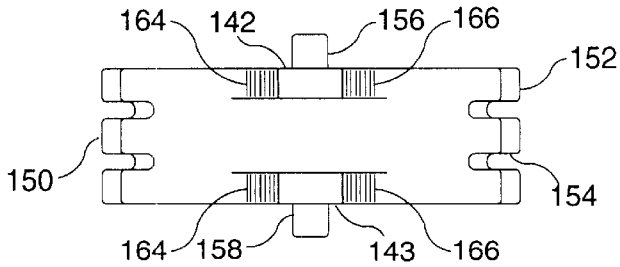
FIG. 8 is a bottom view of the contact element shown in FIG. 3.

As is shown in FIGS. 6, 7 and 8, two spaced apart centering protrusions 142, 143 are disposed along outside edges adjacent to the center of the lower portion of the rocking contact 138. Referring to FIG. 5, the centering protrusions 142, 143 rest between the upright blades 116, 118. The length of each centering protrusion 142, 143 is approximately equal to the space separating the upright blades 116, 118 with a clearance on the order of a few thousandths of an inch. The close fit of the centering protrusions 142, 143 between the upright blades 116, 118 prevents the lateral sliding of the rocking contact 138 when it is in the center position.

The height of the centering protrusions 142, 143 is of the same order of magnitude as the thickness of the rocking contact 138. The shape of the centering protrusions 142, 143 generally comprises two radiused side arcuate surfaces 144, 145 and a relatively larger connecting center surface 146. The arcuate surfaces 144, 145 are chosen so that upon the application of pressure on one side of the rocking actuator 108, they will allow rocking motion of the rocking contact 138 to occur between the upright blades 116, 118. Additionally, the shape of the arcuate surfaces 144, 145 facilitates the return of the rocking contact 138 to a centered position between the upright blades 116, 118 upon the return of the rocking actuator 108 to its centered position.

In another preferred embodiment of the present invention, the centering protrusions 142, 143 are combined into a single protrusion (not shown) by filling the space between them across the center lower portion of the rocking contact 138. This configuration is preferentially fabricated by a casting the rocking contact 138.

Referring again to FIG. 3, the first and second end portions of the rocking contact 138 define first and second rocker contacts 150, 152. The first and second rocker contacts 150, 152 are in a facing relationship with first and second side terminals 120, 122 (or fixed contacts 120, 122), respectively, so that the first rocker contact 150 touches the first fixed contact 120 when the rocking contact 138 rocks to one side, and the second rocker contact 152 touches the second fixed contact 122 when the rocking contact 138 rocks to the other side.

The rocker contacts 150, 152 preferably each have one or more of slots 154 therein as shown in FIG. 6. The slots 154 are useful in retaining electrical grease on the rocker contacts 150, 152. Under arcing conditions, electrical grease is effective in dissolving copper oxides that raise contact resistance. By maintaining sufficient electrical grease on the rocker contacts 150, 152, erosion of surfaces of the rocker contacts 150, 152 is reduced. The electrical grease used is preferably a glycol-based grease, such as electrical greases sold by Syntech Corporation, for example.

The components of the switch 100 may be configured to provide several different types of switch operations by changing the contours of the first, second and connecting camming surfaces 139, 140, 141, with respect to the location of the upright blades 116, 118. For example in an over-center type configuration, the rocking contact 138 remains in a "side on" position when pressure is released from the rocking actuator 108, providing a double throw switch operation. Alternatively, the camming surfaces 139, 140, 141 and upright blades 116, 118 may be configured such that the rocking contact 138 will return to its centered position when pressure is released from the rocking actuator 108, creating a momentary on switch operation.

In another preferred embodiment, first and second side tabs 156, 158 extend outward from the center side portions of the rocking contact 138. The first side tab 156 is movably retained between a pair of ribs (not shown) extending inward from an inside wall of the upper portion 104, while, as may be seen in FIG. 5, the second side tab 158 is movably retained between a pair of upright posts 159, extending upward from the upper surface of the lower portion 106. The retention of the side tabs 156, 158 by the ribs and posts prevents disengagement of the centering protrusions 142, 143 from the upright blades 116, 118, should an external force be applied to the switch 100 which results in dislodging forces on the rocking contact 138 that exceed the retaining capability of the compression spring 128, through the follower 134, to hold the rocking contact 138 in place with respect to the upright blades 116, 118. Such a forceful impact could occur, for example, if the switch 100 is dropped or hits another object.

It should be noted that the side tabs 156, 158 provide no pivoting function. The rotational pivots of rocking contact 138 are at axes comprising a portion of the lower surface of the rocking contact 138 and top inside edges 168, 170 of the upright blades 116, 118. As best shown in FIG. 5, first and second pairs of positioning surfaces 164, 166 are disposed adjacent to the centering protrusions 142, 143. The positioning surfaces 164, 166 are additionally outwardly adjacent to the first and second camming surfaces 139, 140. Referring to FIG. 3, when the rocking contact 138 is in a neutral or centered position, the positioning surfaces 164, 166 rest on the first and second top inside edges 168, 170 of the upright blades 116, 118, respectively. The inside edges 168, 170 are the juncture of the top and the facing surfaces of the upright blades 116, 118, respectively. The positioning surfaces 164, 166 are angled with respect to each other to create V-shape that acts to center the positioning surfaces 164, 166 between the inside edges 168, 170. In a presently preferred embodiment, the positioning surfaces 164, 166 are formed with an angle 172, shown in FIG. 7, of approximately 20 degrees with respect to a plane A, defined as a plane connecting the end portions of the rocker contacts 150, 152. The angle 172 may range from approximately 10 to approximately 40 degrees.

As is shown in FIG. 5, during actuation of the rocking contact 138 in a direction shown in FIG. 4, the first positioning surface 164 breaks contact with the first inside edge 168, while the second positioning surface 166 maintains contact with and rotates around the second inside edge 170, and the second inside edge acts as a fulcrum. In a like manner, when the rocking contact 138 is actuated in the opposite direction, the second positioning surface 166 breaks contact with the second inside edge 170, while the first positioning surface 164 maintains contact with and rotates around the first inside edge 168, the first inside edge acting as the fulcrum.

Referring again to FIG. 7, the positioning surface angle 172 will vary based on the relationship between the size and shape of the rocking contact 138 and the height of the side terminals 120, 122, with respect to the height of the upright blades 116, 118. The angle 172 is set to allow the first and second rocker contacts 150, 152 to connect with their respective side terminals 120, 122, without causing the positioning surfaces 164, 166 to transfer the pivot to the top of, or to an outside edge of the upright blades 116, 118.

As shown in FIG. 5, the follower 134 has an upper cylindrical portion 176, which slidably conforms to spring housing 124, and a lower portion 178, which always remains in contact with one of the camming surfaces 139, 140, 141. In a presently preferred embodiment, the lower portion 178 has a chisel shape terminating in a relatively small cylindrical radius tip 180. In another preferred embodiment the lower portion comprises a conical shape having a small spherical tip (not shown).

Figure 5A:
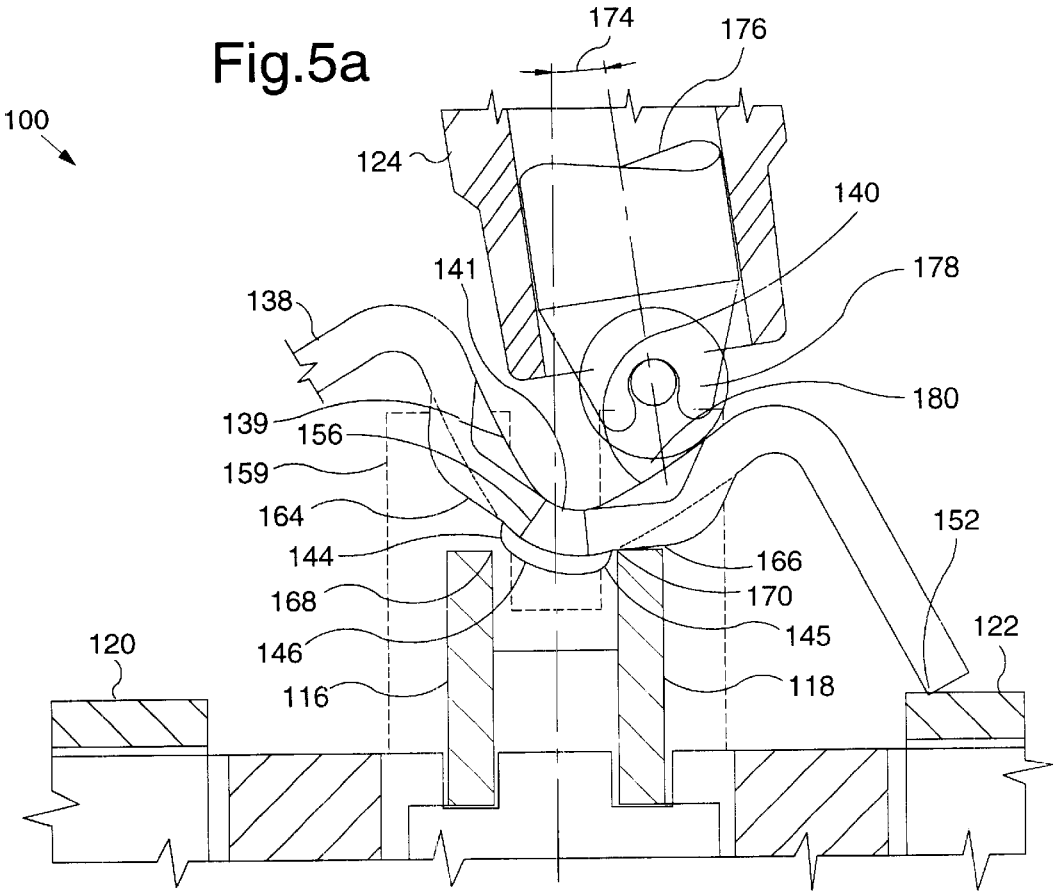
FIGS. 5*a*–5*c* show three views of a modified version of the actuating elements shown in FIG. 3.
Figure 5B:
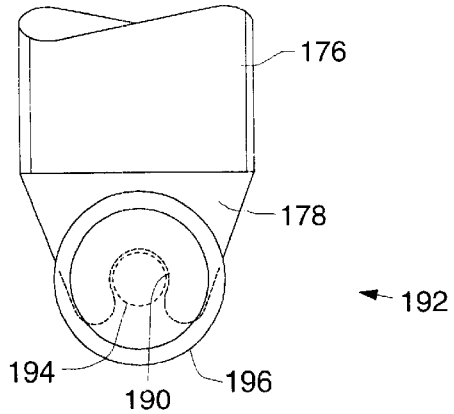
Figure 5C:
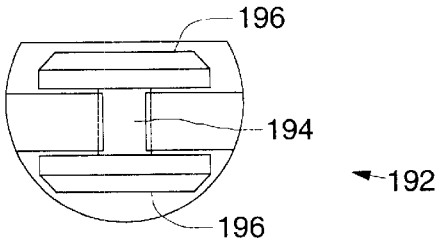

In yet another preferred embodiment, shown in FIGS. 5*a*–5*c*, the lower portion 178 includes a barbell-shaped roller 192. The lower portion 178 is flattened with the flat part having a recessed groove 190 formed therein. The roller 192 includes a central member 194 that is retained in the groove 190 and two outer cylindrical rolling members 196. The two rolling members 196 act upon the camming surfaces 139, 140 of contact 138. This embodiment may be used to maximize the contact force between the rocker contacts 150, 152 and their respective side terminals 120, 122, while permitting a relatively light actuating force with a positive return. This embodiment reduces the maximum actuation force by approximately 50%, while reducing the variation of actuating force by approximately 50%. This results in a better "feel" during actuation of the switch 100.

Referring again to FIGS. 3, 4 and 5, when the rocking actuator 108 is in a horizontal (center) position, the tip 180 is in contact with the connecting camming surface 141, resulting in the force of the spring 128 being transferred to the rocking contact 138. As a result, the first and second positioning surfaces 164, 166 are evenly biased against the inside edges 168, 170, keeping the contact 138 level and away from the side terminals 120, 122. In this state the switch 100 is off. When pressure is applied to one side of the rocking actuator 108, the actuator rotates around the pivot 110, while the tip 180 moves into contact with one of the first or second camming surfaces 139, 140. This causes the force of the spring 128 to be transferred to one of the first or second positioning surfaces 164, 166 and that positioning surface to be biased against one of the inside edges 168, 170. As the rocking actuator 108 continues its rotation, the tip 180 continues its movement along the first or second camming surface 139, 140 to a point where the spring force is transferred outside the edge 169 or 170 causing the rocking contact 138 to tilt.

More specifically, when the tip 180 moves along the second camming surface 140, past the inside edge 170, the force of the tip 180 applied to the second camming surface 140 causes the rocking contact 138 to tilt towards the side terminal 122. The rocking contact 138 comes to rest with contact positioning surface 166 supported by the inside edge 170, while rocking contact tip 152 rests on side terminal 122. In this state positioning surface 166 is not in contact with the top or the outside edge of the upright blade 118.

The pivoting motion of the rocking actuator 108 with respect to the housing 104, may be measured angularly as the displacement of the rocking actuator 108 between its centered off position and its displaced on position. This rotation of the actuator 108 may also be measured as displacement of the spring housing 124 from an off position to an on position, shown as angle 174 in FIG. 5. In a presently preferred embodiment this angle 174 may be less than ten degrees, permitting actuation of the switch 100 with a relatively small movement of the rocking actuator 108 with respect to prior art switches.

An important aspect of the present invention is the differing geometry of the upper and lower surfaces of the rocking contact 138. The separation of the protrusions 142, 143 and the positioning surfaces 164, 166, which stabilize the various positions of the rocking contact 138, from the camming surfaces 139, 140, 141, which receive the force which causes the rocking position to change position, permits each of these surfaces to each be optimized for the function they perform. The close proximity of inside edges 168, 170 presents difficulties in the rocking contact 138 predictably and reliably returning to the center off position. If the positioning and camming surfaces 164, 166, 139, 140, 141 were merely parallel opposite sides of the rocking contact 138, this reliability could not be accomplished.

While the present invention is disclosed with regard to specific embodiments thereof, it is to be understood that many alternatives, modifications, and variations will be apparent to those skilled in the art in light of the foregoing description. For example, a double pole variation of the invention may be created by placing two embodiments of the present switch 100 adjacent to each other, enclosed in a single housing. By changing the relationship of the switch elements with respect to each other, the invention may be configured to have a single throw momentary or bistable action. It may additionally be configured to have a double throw momentary, bistable or tristable action.

Thus, improved gull wing type rocking switches have been disclosed. In view of the above, it is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An electric rocker switch comprising:

a rocking contact having an upper surface including camming surfaces, a lower surface including first and second positioning surfaces, a first rocker contact disposed on a first end and a second rocker contact disposed on a second end;

a movable follower in contact with the camming surfaces whose motion causes the rocking contact to rock from side to side;

first and second side terminals disposed such that the first rocker contact contacts the first side terminal when the rocking contact is rocked toward the first end and the second rocker contact contacts the second side terminal when the rocking contact is rocked toward the second end;

a center terminal having first and second blades, and wherein the positioning surfaces rest on the blades of the center terminal and the center terminal acts as a fulcrum when the rocking contact is rocked from side to side; and at least one centering protrusion disposed on the lower surface of the rocking contact disposed between the first and second blades of the center terminal when the rocking contact is in the center position.

2. The electric rocker switch according to claim 1 wherein the rocking contact has a gull wing shape.

3. The electric rocker switch according to claim 1 wherein each of the blades has a fulcrum edge on which the positioning surfaces rest when the rocking contact is in a center position and wherein the positioning surfaces comprise pivot points when the rocking contact is rocked from side to side.

4. The electric rocker switch according to claim 1 wherein the at least one centering protrusion further comprises a first arcuate surface, a spaced apart second arcuate surface and a third surface connecting the first and second arcuate surfaces.

5. The electric rocker switch according to claim 1 wherein contours of the camming surfaces differ from the contour of the positioning surfaces.

6. The electric rocker switch according to claim 1 wherein the positioning surfaces are inclined with respect to each other.

7. The electric rocker switch according to claim 6 wherein the angle of inclination is between approximately 10 degrees to approximately 40 degrees.

8. The electric rocker switch according to claim 1 wherein the first blade has a top inside edge and the second blade has a top inside edge in a facing relationship to the top inside edge of the first blade, the positioning surfaces resting on the top inside edges when the rocking contact is in a center position, the positioning surfaces alternately acting as pivot points and the top inside edges alternately acting as fulcrums when the rocking contact is rocked from side to side.

9. The electric rocker switch according to claim 1 wherein the follower comprises a roller tip that contacts the camming surfaces.

10. The electric rocker switch according to claim 9 wherein the follower comprises a recessed groove located at an end adjacent the camming surfaces which has a barbell-shaped roller tip rollably secured therein.

11. An electric rocker switch, comprising:

a switch housing having a bottom wall;

a center terminal formed on the bottom wall and having first and second blades;

at least one fixed contact formed on the bottom wall;

a rocking contact for rocking on the center terminal which acts as a fulcrum, which rocking causes the rocking contact to contact and separate from the at least one fixed contact; and a centering protrusion attached to the rocking contact and positioned between the first and second blades for laterally centering the rocking contact.

12. The electric rocker switch according to claim 11 wherein the rocking contact has a gull wing shape.

13. The electric rocker switch according to claim 11 further comprising at least one positioning surface that serves as a pivot point on a top inside edge of at least one of the blades when the rocking contact is rocked from side to side.

14. The electric rocker switch according to claim 11 further comprising first and second positioning surfaces located adjacent the centering protrusion that serve as pivot points on inside edges of the first and blades, respectively, when the rocking contact is rocked from side to side.

15. The a electric rocker switch according to claim 11 wherein the at least one positioning surface has an angle of inclination.

16. The electric rocker switch according to claim 15 wherein the angle of inclination of the at least one positioning surface is between about 10 degrees and about 40 degrees.

17. A rocking contact for use in an electric switch having a pair of upright blades, comprising:

a lower positioning surface dimensioned to rest atop the upright blades when the rocking contact is in a neutral position and to rock atop one of the upright blades when the rocking contact is rocked from side to side; and a centering protrusion disposed on the lower surface of the rocking contact and resting between the upright blades when the rocking contact is in the neutral position.

18. The rocking contact according to claim 17 which has a gull wing shape.

19. The rocking contact according to claim 17 wherein the centering protrusion further comprises a first arcuate surface, a spaced apart second arcuate surface and a third surface connecting the first and second arcuate surfaces.

20. The rocking contact according to claim 17 wherein the lower positioning surface serves as a pivot point about a single fulcrum point on each of the upright blades when the rocking contact is rocked from side to side.

21. The rocking contact according to claim 17 wherein the positioning surface has an angle of inclination.

22. The rocking contact according to claim 21 wherein the angle of inclination of the positioning surface is between about 10 degrees and about 40 degrees.

* * * * *